US009107463B2

(12) United States Patent
Ozawa et al.

(10) Patent No.: US 9,107,463 B2
(45) Date of Patent: Aug. 18, 2015

(54) METHOD FOR INTEGRATING MULTI-LAYER SHEET FABRIC PIECES FOR USE IN A CHEMICAL PROTECTIVE SUIT

(75) Inventors: Takashi Ozawa, Saitama (JP); Kazutaka Tanino, Saitama (JP); Seiko Nitta, Tokyo (JP)

(73) Assignee: SHIGEMATSU WORKS CO., LTD., Tokyo (JP)

( * ) Notice: Subject to any disclaimer, the term of this patent is extended or adjusted under 35 U.S.C. 154(b) by 33 days.

(21) Appl. No.: 13/819,210

(22) PCT Filed: Aug. 26, 2010

(86) PCT No.: PCT/JP2010/064529

§ 371 (c)(1),
(2), (4) Date: Feb. 26, 2013

(87) PCT Pub. No.: WO2012/026029

PCT Pub. Date: Mar. 1, 2012

(65) Prior Publication Data

US 2013/0153131 A1 Jun. 20, 2013

(51) Int. Cl.

| | |
|---|---|
| ***A41H 43/04*** | (2006.01) |
| ***A41D 27/24*** | (2006.01) |
| ***A62B 17/00*** | (2006.01) |

(52) U.S. Cl.

CPC ..... *A41H 43/04* (2013.01); *A41D 27/24* (2013.01); *A41D 27/245* (2013.01); *A62B 17/006* (2013.01); *Y10T 156/1051* (2015.01)

(58) Field of Classification Search

CPC ..... A41H 43/04; A41D 27/245; Y10T 156/1051; A62B 17/006

USPC ..... 2/457, 458, 456, 275, 82; 156/73.4, 156/73.5, 275.1, 290, 308.4, 93

See application file for complete search history.

(56) References Cited

U.S. PATENT DOCUMENTS

| | | | |
|---|---|---|---|
| 2,655,663 | A | 10/1953 | Hoagland |
| 3,431,133 | A | 3/1969 | Braude et al. |

(Continued)

FOREIGN PATENT DOCUMENTS

| | | | |
|---|---|---|---|
| JP | 59-59322 | U | 4/1984 |
| JP | 02-229276 | A | 9/1990 |

(Continued)

OTHER PUBLICATIONS

Office Action issued in co-pending related Japanese Application 2010-1900856 on Sep. 18, 2013.

(Continued)

*Primary Examiner* — Jacob T Minskey
*Assistant Examiner* — Vishal I Patel
(74) *Attorney, Agent, or Firm* — Griffin & Szipl, P.C.

(57) ABSTRACT

[Object of the Invention] An object of the present invention is to provide a method for integrating multi-layer sheet fabric pieces for use in a chemical protective suit, wherein fewer fabrication man-hours are required than in the conventional method.

[Disclosure of the Invention] A method for integrating multi-layer sheet fabric pieces for use in a chemical protective suit comprises the steps of (a) stacking one of a pair of multi-layer sheet fabric pieces for use in a chemical protective suit, each of which comprises a front surface layer of thermoplastic resin film, a rear surface layer of thermoplastic resin film, and at least one middle layer of chemical permeability resistant resin film, on the other of the pair of multi-layer sheet fabric pieces, with a part of a peripheral edge of one multi-layer sheet fabric piece opposed to a part of a peripheral edge of the other multi-layer sheet fabric piece, (b) seaming the stacked multi-layer sheet fabric pieces at a portion close to the peripheral edges opposed to each other along the peripheral edges opposed to each other so as to form a seam line, and (c) high frequency dielectric heating the stacked multi-layer sheet fabric pieces at a band portion of predetermined breadth close to the seam line along the seam line, wherein the peripheral edges opposed to each other and the band portion are disposed to face opposite sides of the seam line, so as to weld and integrate the stacked multi-layer sheet fabric pieces with each other at the band portion.

4 Claims, 2 Drawing Sheets

(56) References Cited

U.S. PATENT DOCUMENTS

| | | | | |
|---|---|---|---|---|
| 3,496,572 | A | 2/1970 | Herzig | |
| 3,911,913 | A | 10/1975 | June | |
| 4,023,223 | A | 5/1977 | Anderson et al. | |
| 4,272,851 | A * | 6/1981 | Goldstein | 2/79 |
| 4,831,664 | A | 5/1989 | Suda | |
| 4,847,914 | A | 7/1989 | Suda | |
| 4,901,370 | A | 2/1990 | Suda | |
| 4,920,575 | A * | 5/1990 | Bartasis et al. | 2/457 |
| 4,924,525 | A | 5/1990 | Bartasis | |
| 5,005,216 | A | 4/1991 | Blackburn et al. | |
| 5,017,424 | A * | 5/1991 | Farnworth et al. | 442/71 |
| 5,119,515 | A | 6/1992 | Altinger | |
| 5,385,774 | A | 1/1995 | Cramer et al. | |
| 5,885,679 | A * | 3/1999 | Yasue et al. | 428/57 |
| 5,918,314 | A | 7/1999 | Moses | |
| 5,960,475 | A | 10/1999 | Fewtrell | |
| 6,748,609 | B1 | 6/2004 | Garigan | |
| 7,328,459 | B2 | 2/2008 | Walsh et al. | |
| 7,448,093 | B1 | 11/2008 | Ruck | |
| 7,770,235 | B2 | 8/2010 | Lepage et al. | |
| 8,028,351 | B2 | 10/2011 | Stachler et al. | |
| 2009/0255039 | A1 * | 10/2009 | Danielsson | 2/458 |
| 2010/0071115 | A1 * | 3/2010 | Sadato | 2/243.1 |
| 2013/0239301 | A1 | 9/2013 | Broderick | |

FOREIGN PATENT DOCUMENTS

| | | | |
|---|---|---|---|
| JP | 09-000651 | | 1/1997 |
| JP | 09-000651 | A | 1/1997 |
| JP | 2004-208824 | | 7/2004 |
| JP | 2005-200778 | | 7/2005 |
| JP | 2006-249602 | A | 9/2006 |
| JP | 2008-212162 | A | 9/2008 |

OTHER PUBLICATIONS

International Search Report in corresponding application No. PCT/JP2010/064529, completed Sep. 9, 2010 and mailed Sep. 21, 2010.

Microfilm of the specification and drawings annexed to the request of Japanese Utility Model Application No. 155641/1982 (Laid-open No. 059322/1984), Apr. 18, 1984 (see also Foreign Reference No. 1).

Microfilm of the specification and drawings annexed to the request of Japanese Utility Model Application No. 001364/1974 (Laid-open No. 095107/1975), Aug. 9, 1975.

Written Opinion of the International Searching Authority in corresponding application PCT/JP2010/064529, completed Sep. 9, 2010 and mailed Sep. 21, 2010.

International Preliminary Report on Patentability issued in corresponding application PCT/JP2010/064529, completed Aug. 3, 2012.

Office Action issued in co-pending related U.S. Appl. No. 13/819,266 on Nov. 5, 2014.

* cited by examiner

METHOD FOR INTEGRATING MULTI-LAYER SHEET FABRIC PIECES FOR USE IN A CHEMICAL PROTECTIVE SUIT

This is a National Phase Application in the United States of International Patent Application No. PCT/JP2010/064529 filed Aug. 26, 2010, the entire disclosure of which is hereby incorporated by reference.

TECHNICAL FIELD

The present invention relates to a method for integrating multi-layer sheet fabric pieces for use in a chemical protective suit

BACKGROUND ART

As shown in FIG. 1, a conventional method for integrating multi-layer sheet fabric pieces for use in a chemical protective suit carried out for producing a chemical protective suit comprises the steps of (a) stacking one piece 12 of a pair of multi-layer sheet fabric pieces 12, 13, each of which comprises a front surface layer of synthetic rubber film, a rear surface layer of synthetic rubber film, and at least one middle layer of chemical permeability resistant resin film, on the other piece 13 of the pair of multi-layer sheet fabrics 12, 13, with a part 12*a* of a peripheral edge of the multi-layer sheet fabric piece 12 opposed to a part 13*a* of a peripheral edge of the multi-layer sheet fabric piece 13, (b) seaming the stacked multi-layer sheet fabric pieces at a portion close to the peripheral edges 12*a*, 13*a* opposed to each other along the peripheral edges 12*a*, 13*a* so as to form a seam line 14, (c) folding the multi-layer sheet fabric piece 12 toward the seam line 14 at a portion away from the seam line 14 beyond a band portion of predetermined breadth so as to form a folding line 12*b*, wherein the peripheral edge 12*a* and the band portion are disposed to face the opposite sides of the seam line 14, (d) seaming the triply stacked multi-layer sheet fabric pieces at a portion close to the folding line 12*b* so as to form a seam line 15, (e) sticking a synthetic rubber tape 16 on the multi-layer sheet fabric pieces 12, 13 so as to cover a portion of the multi-layer sheet fabric piece 12 of predetermined breadth at one side of the folding line 12*b*, a portion of the multi-layer sheet fabric piece 13 of predetermined breadth at the other side of the folding line 12*b*, and the folding line 12*b* by the synthetic rubber tape 16, (f) welding the stacked potions of the synthetic rubber tape 16 and the multi-layer sheet fabric pieces 12, 13 using an external heat source so as to integrate them with each other, and (g) sticking a rubber coated sheet fabric piece 17 on the multi-layer sheet fabric pieces 12, 13 so as to cover a portion of the multi-layer sheet fabric piece 12 of predetermined breadth at one side of the peripheral edges 12*a*, 13*a*, a portion of the multi-layer sheet fabric piece 13 of predetermined breadth at the other side of the peripheral edges 12*a*, 13*a*, and the peripheral edges 12*a*, 13*a*. When the chemical protective suit is completed, the synthetic rubber tape 16 is exposed to the external air and the rubber coated sheet fabric piece 17 is exposed to the internal air of the suit.

In the aforementioned method, air tightness and chemical permeability resistance are achieved by sticking the synthetic rubber tape 16 on the outside surface of the stacked portion of the multi-layer sheet fabric pieces 12, 13 and the folding line 12*b*, welding the synthetic rubber tape 16, and sticking the rubber coated sheet fabric piece 17 on the inside surface of the stacked portion of the multi-layer sheet fabric pieces 12, 13 and the peripheral edges 12*a*, 13*a* so as to shut the spaces among the stacked sheet fabric pieces 12, 13 off from the internal air and the external air.

DISCLOSURE OF INVENTION

Problem to be Solved

The conventional method for integrating multi-layer sheet fabric pieces for use in a chemical protective suit has a problem in that the method causes an increase in fabrication man-hours because it requires the five steps of producing the seam line 14, producing the seam line 15, sticking the synthetic rubber tape 16 on the multi-layer sheet fabric pieces, welding the synthetic rubber tape 16 using an external heat source, and sticking the rubber coated sheet fabric 17 on the multi-layer sheet fabric pieces.

Therefore, an object of the present invention is to provide a method for integrating multi-layer sheet fabric pieces for use in a chemical protective suit, wherein fewer fabrication man-hours are required than in the conventional method.

Means for Achieving the Object

In accordance with the present invention, there is provided a method for integrating multi-layer sheet fabric pieces for use in a chemical protective suit comprising the steps of (a) stacking one of a pair of multi-layer sheet fabric pieces for use in a chemical protective suit, each of which comprises a front surface layer of thermoplastic resin film, a rear surface layer of thermoplastic resin film, and at least one middle layer of chemical permeability resistant resin film, on the other of the pair of multi-layer sheet fabric pieces, with a part of a peripheral edge of one multi-layer sheet fabric piece opposed to a part of a peripheral edge of the other multi-layer sheet fabric piece, (b) seaming the stacked multi-layer sheet fabric pieces at a portion close to the peripheral edges opposed to each other along the peripheral edges opposed to each other so as to form a seam line, and (c) high frequency dielectric heating the stacked multi-layer sheet fabric pieces at a band portion of predetermined breadth close to the seam line along the seam line, wherein the peripheral edges opposed to each other and the band portion are disposed to face opposite sides of the seam line, thereby welding and integrating the stacked multi-layer sheet fabric pieces with each other at the band portion.

In accordance with a preferred aspect of the present invention, the method further comprises, between the steps (b) and (c), the step of (d) folding one of the stacked multi-layer sheet fabric pieces toward the seam line at a portion away from the seam line beyond a band portion of predetermined breadth close to the seam line, wherein the peripheral edges opposed to each other and the band portion are disposed to face opposite sides of the seam line, and wherein the high frequency dielectric heating is carried out on triply stacked multi-layer sheet fabric pieces in the step (c).

In the method of the present invention, the stacked multi-layer sheet fabric pieces are heated and welded at a band portion of predetermined breadth close to the seam line, wherein the band portion and the peripheral edges opposed to each other are disposed to face opposite sides of the seam line, so as to drive out the spaces between or among the stacked sheet fabric pieces at the band portion of predetermined breadth. Air tightness and chemical permeability resistance of the integrated portion of the stacked sheet fabric pieces are secured by driving out the spaces between or among the stacked sheet fabric pieces at the band portion of predetermined breadth.

When the present invention is applied to the integrated portion of the stacked sheet fabric pieces including a folded portion as shown in FIG. 1, the triply stacked portion close to the folding line is welded and integrated by high frequency dielectric heating. Thus, the conventional three steps of seaming the triply stacked portion close to the folding line, sticking the synthetic rubber tape on the sheet fabric pieces, and sticking the rubber coated sheet fabric piece on the sheet fabric pieces are eliminated.

In accordance with a preferred aspect of the present invention, the thermoplastic resin film forming the front surface layer and the rear surface layer is polyurethane resin film.

In accordance with a preferred aspect of the present invention, the thermoplastic resin film forming the front surface layer and the rear surface layer is polyvinyl chloride resin film.

The polyurethane resin film or the polyvinyl chloride resin film is suitably welded by high frequency dielectric heating.

In accordance with a preferred aspect of the present invention, each of the multi-layer sheet fabric pieces further comprises a middle layer of lattice fabric.

The sheet fabric piece for use in a chemical protective suit is desirably provided with a middle layer of lattice fabric so as to protect the middle layer of the chemical permeability resistant resin film.

BEST MODES FOR CARRYING OUT THE INVENTION

Methods for integrating multi-layer sheet fabric pieces for use in a chemical protective suit in accordance with preferred embodiments of the present invention will be described.

Figure 2:
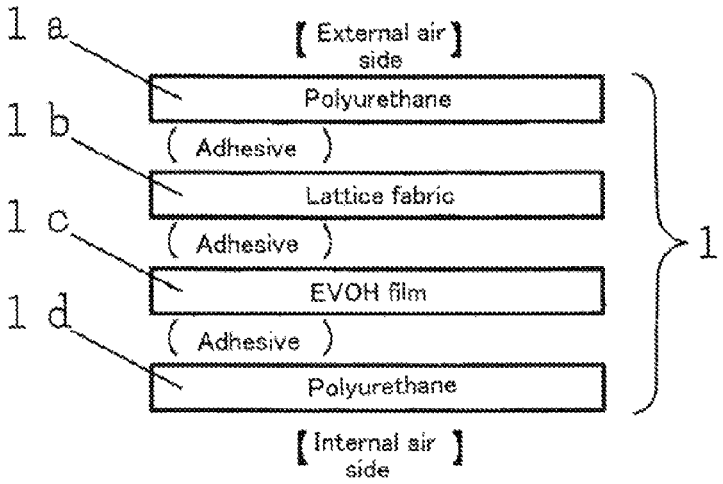
FIG. 2 is a sectional view of a sheet fabric piece for use in a preferred embodiment of the present invention.

As shown in FIG. 2, a sheet fabric 1 for use in a chemical protective suit has a multi-layer structure comprising a front surface layer 1*a* made of polyurethane resin film to be exposed to the external air when the sheet fabric 1 forms a chemical protective suit, a rear surface layer 1*d* made of polyurethane resin film to be exposed to the internal air when the sheet fabric 1 forms a chemical protective suit, a lattice fabric middle layer 1*b* disposed between the front surface layer 1*a* and the rear surface layer ld and located close to the front surface layer 1*a*, an EVOH (ethylene vinyl alcohol copolymer) film middle layer 1*c*, which is a chemical permeability resistant resin film, disposed between the front surface layer 1*a* and the rear surface layer 1*d* and located close to the rear surface layer 1*d*, and adhesives disposed between the layers to bond them to one another.

The sheet fabric 1 is cut into a plurality of pieces of predetermined shapes. The plurality pieces of the sheet fabric 1 are integrated into a unitary body to form a chemical protective suit.

Figure 3:
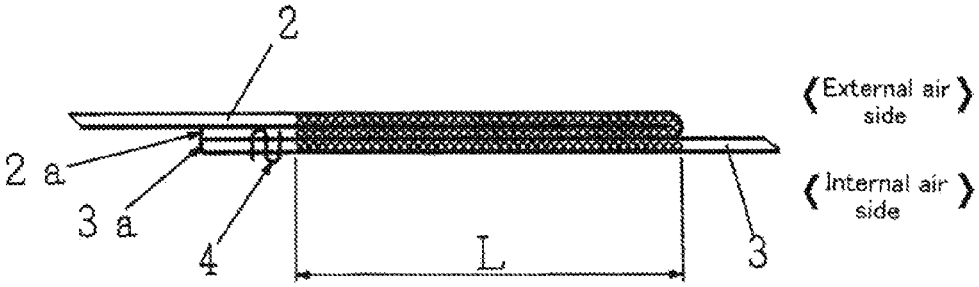
FIG. 3 is a sectional view of stacked sheet fabric pieces for use in a chemical protective suit integrated by a method in accordance with a first preferred embodiment of the present invention.

As shown in FIG. 3, a first method for integrating a plurality of sheet fabric pieces comprises the steps of (a) making a part 2*a* of the peripheral edge of a sheet fabric piece 2, whose front surface layer 1*a* is directed downward, oppose a part 3*a* of the peripheral edge of a sheet fabric piece 3, whose front surface layer 1*a* is directed upward, (b) stacking a peripheral portion of the sheet fabric piece 2 including the peripheral edge 2*a* on a peripheral portion of the sheet fabric piece 3 including the peripheral edge 3*a*, (c) seaming the stacked sheet fabric pieces 2 and 3 at a portion close to the peripheral edges 2*a* and 3*a* along the peripheral edges 2*a* and 3*a* so as to make a seam line 4, (d) folding the sheet fabric piece 2 toward the seam line 4 at a portion away from the seam line 4 beyond a band portion of predetermined breadth close to the seam line 4, wherein the band portion and the peripheral edges 2*a* and 3*a* are disposed to face opposite sides of the seam line 4, (e) high frequency dielectric heating the triply stacked sheet fabric pieces 2 and 3, wherein the sheet fabric piece 2 is stacked on itself and the sheet fabric 3 is stacked on the stacked sheet fabric pieces 2, at a band portion of predetermined breadth L close to the seam line 4 along the seam line 4, and wherein the peripheral edges 2*a* and 3*a* and the band portion of predetermined breadth L are disposed to face opposite sides of the seam line 4, thereby welding and integrating the triply stacked sheet fabric pieces 2 and 3 with each other at the band portion of predetermined breadth L.

The stacked sheet fabric pieces 2 and 3 can be welded and integrated with each other by the high frequency dielectric heating because the sheet fabric 1 comprises the front surface layer made of thermoplastic polyurethane resin film and the rear surface layer made of thermoplastic polyurethane resin film.

The portion to be welded and integrated desirably includes the folding line.

When the sheet fabric pieces are integrated and a chemical protective suit is completed, the folded portion of the sheet fabric piece 2 is exposed to the external air.

The folded sheet fabric piece 2 and the sheet fabric piece 3 are welded and integrated with each other at the portion of predetermined breadth L along the seam line 4 so as to drive out the spaces among the triply stacked sheet fabric pieces 2 and 3 at the portion of predetermined breadth L. Thus, air tightness and chemical permeability resistance of the integrated portion between the sheet fabric pieces 2 and 3 are achieved.

Figure 1:
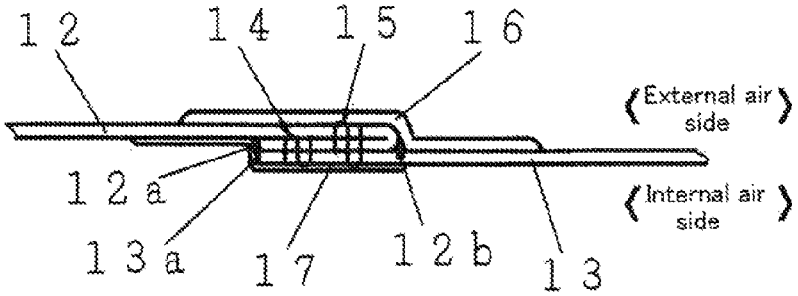
FIG.1 Prior Art
FIG. 1 is a sectional view of stacked sheet fabric pieces for use in a chemical protective suit integrated by the conventional method.

In the first integrating method, the three steps of seaming triply stacked portion close to the folding line, sticking the synthetic rubber tape on the sheet fabric pieces, and sticking the rubber coated sheet fabric piece on the sheet fabric pieces, which are necessary steps in the conventional method shown in FIG. 1, can be eliminated.

The portion to be welded and integrated includes the folding line of the sheet fabric piece 2. Thus, foreign substances are prevented from getting in the space between the folded portion of the sheet fabric piece 2 and the sheet fabric piece 3 and gradual peeling with age of the sheet fabric piece 2 off the sheet fabric piece 3 at the welded and integrated portion is prevented.

The lattice fabric middle layer 1*b* is located closer to the external air than the EVOH film middle layer 1*c*. Thus, the EVOH film middle layer 1*c* is protected from damage due to external force.

The first integrating method can be used in forming the leg portion, the body portion, the arm portion and the head portion of a chemical protective suit.

Figure 4:
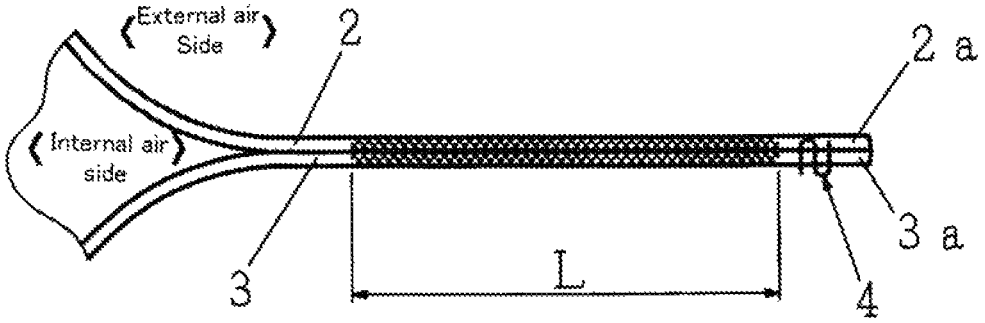
FIG. 4 is a sectional view of stacked sheet fabric pieces for use in a chemical protective suit integrated by a method in accordance with a second preferred embodiment of the present invention.

As shown in FIG. 4, a second method for integrating a plurality of sheet fabric pieces comprises the steps of (a)

making a part 2*a* of the peripheral edge of a sheet fabric piece 2, whose front surface layer 1*a* is directed upward, oppose a part 3*a* of the peripheral edge of a sheet fabric piece 3, whose front surface layer 1*a* is directed downward, (b) stacking the peripheral portion of the sheet fabric piece 2 including the peripheral edge 2*a* on the peripheral portion of the sheet fabric piece 3 including the peripheral edge 3*a*, (c) seaming the stacked sheet fabric pieces 2 and 3 at a portion close to the peripheral edges 2*a* and 3*a* along the peripheral edges 2*a* and 3*a* so as to make a seam line 4, (d) high frequency dielectric heating the stacked sheet fabric pieces 2 and 3 at a band portion of predetermined breadth L close to the seam line 4 along the seam line 4, wherein the peripheral edges 2*a* and 3*a* and the band portion are disposed to face opposite sides of the seam line 4, thereby welding and integrating the stacked sheet fabric pieces 2 and 3 with each other at the band portion.

The sheet fabric pieces 2 and 3 are welded and integrated with each other at the band portion of predetermined breadth L along the seam line 4 so as to drive out the spaces between the stacked sheet fabric pieces 2 and 3 at the band portion of predetermined breadth L. Spaces between the stacked sheet fabric pieces 2 and 3 are driven out at the band portion closer to the internal air than the seam line 4. Thus, air tightness and chemical permeability resistance of the integrated portion between the sheet fabric pieces 2 and 3 are achieved.

Also in the second integrating method, the three steps of seaming triply stacked portion close to the folding line, sticking the synthetic rubber tape on the sheet fabric pieces, and sticking the rubber coated sheet fabric piece on the sheet fabric pieces, which are necessary steps in the conventional method shown in FIG. 1, can be eliminated.

The second integrating method can be used in forming the foot portions of a chemical protective suit provided with foot portions extending from the calves to the toes.

Polyurethane resin film is used for the front surface layer and the rear surface layer of the sheet fabric in the aforementioned preferred embodiments. However, not only polyurethane resin film but also any other type of thermal plastic resin film which can be welded by high frequency dielectric heating can be used for the front surface layer and the rear surface layer of the sheet fabric. Polyvinyl chloride resin film can preferably used for the front surface layer and the rear surface layer of the sheet fabric.

The breadth L of the welded and integrated portion is suitably decided for the particular type of resin film used.

INDUSTRIAL APPLICABILITY

The present invention can be widely used for production of a chemical protective suit.

BRIEF DESCRIPTION OF THE REFERENCE NUMERALS

1 Sheet fabric for use in a chemical protective suit
2, 3 Sheet fabric piece
4 Seam line
L Predetermined breadth of welded and integrated portion

The invention claimed is:

1. A method for integrating multi-layer sheet fabric pieces for use in a chemical protective suit comprising the steps of:

(a) stacking one of a pair of multi-layer sheet fabric pieces for use in a chemical protective suit, each of which comprises a front surface layer of thermoplastic resin film, a rear surface layer of thermoplastic resin film, and at least one middle layer of chemical permeability resistant resin film, on the other of the pair of multi-layer sheet fabric pieces, with a part of a peripheral edge of one multi-layer sheet fabric piece opposed to a part of a peripheral edge of the other multi-layer sheet fabric piece;

(b) seaming the stacked multi-layer sheet fabric pieces at a portion close to the peripheral edges opposed to each other along the peripheral edges opposed to each other so as to form a single seam line;

(c) folding one of the stacked multi-layer sheet fabric pieces toward the seam line at a portion away from the seam line beyond a band portion of predetermined breadth close to the seam line, wherein the peripheral edges opposed to each other and the band portion are disposed to face opposite sides of the seam line; and (d) high frequency dielectric heating the stacked multi-layer sheet fabric pieces along the seam line at a band portion of predetermined breadth close to, but not including, the seam line along the seam line, wherein the peripheral edges opposed to each other and the band portion are disposed to face opposite sides of the seam line, thereby welding and integrating the stacked multi-layer sheet fabric pieces with each other at the band portion, wherein the steps are performed in the order of (a)-(d), and wherein the high frequency dielectric heating is carried out on triply stacked multi-layer sheet fabric pieces in step (d).

2. A method for integrating multi-layer sheet fabric pieces for use in a chemical protective suit of claim 1, wherein the thermoplastic resin film forming the front surface layer and the rear surface layer is polyurethane resin film.

3. A method for integrating multi-layer sheet fabric pieces for use in a chemical protective suit of claim 1, wherein the thermoplastic resin film forming the front surface layer and the rear surface layer is polyvinyl chloride resin film.

4. A method for integrating multi-layer sheet fabric pieces for use in a chemical protective suit of claim 1, wherein each of the multi-layer sheet fabric pieces further comprises a middle layer of lattice fabric.

* * * * *